United States Patent [19]

Wahl et al.

[11] Patent Number: 4,724,614

[45] Date of Patent: Feb. 16, 1988

[54] BLADE ATTACHMENTS FOR ELECTRIC BEARD TRIMMERS

[75] Inventors: John F. Wahl, Sterling; Steven Gatz, Galt, both of Ill.

[73] Assignee: Wahl Clipper Corporation, Sterling, Ill.

[21] Appl. No.: 846,615

[22] Filed: Apr. 1, 1986

[51] Int. Cl.[4] ..... B26B 19/20; B26B 19/02

[52] U.S. Cl. ..... 30/200; 30/233.5

[58] Field of Search ..... 30/200, 201, 233.5

[56] References Cited

U.S. PATENT DOCUMENTS

| | | | |
|---|---|---|---|
| D. 215,640 | 10/1969 | Popeil . | |
| 1,628,421 | 5/1927 | Patenaude | 30/200 |
| 1,753,750 | 4/1930 | McArdle | 30/201 |
| 2,221,314 | 7/1937 | Nyhagen . | |
| 2,747,277 | 5/1956 | Esposito | 30/200 |
| 2,880,504 | 9/1957 | Finn . | |
| 2,932,891 | 7/1957 | Waggoner . | |
| 3,008,233 | 4/1957 | Waggoner . | |
| 3,107,423 | 10/1963 | Caesar . | |
| 3,178,815 | 4/1965 | Madrid . | |
| 3,344,520 | 10/1967 | Williams | 30/200 |
| 4,614,036 | 9/1986 | Haraguchi | 30/200 |
| 4,622,745 | 11/1986 | Wahl | 30/201 |

FOREIGN PATENT DOCUMENTS

| | | | |
|---|---|---|---|
| 54-140656 | 1/1979 | Japan | 30/201 |

OTHER PUBLICATIONS

"Blade Guard", manufactured by Wahl Clipper Corporation, Sterling, Ill. 61081.

*Primary Examiner*—E. R. Kazenske
*Assistant Examiner*—Michael D. Folkerts
*Attorney, Agent, or Firm*—Welsh & Katz, Ltd.

[57] ABSTRACT

An attachment is provided for electric beard trimmers which spaces the teeth on the blades of the trimmer a desired distance from the skin to produce stubble having the appearance of uniform growth. The attachment may be selectively secured to and removed from the trimmer. The attachment covers the cutting teeth on the blades and includes a plurality of openings which expose selected teeth on the trimmer blades. The length of the trimmed stubble may be between about 0.010 inches and 0.090 inches or more, and is determined by the configuration of the blades of the trimmer and the thickness of the attachment.

2 Claims, 7 Drawing Figures

BLADE ATTACHMENTS FOR ELECTRIC BEARD TRIMMERS

This invention relates to attachments for electric beard trimmers, and more particularly, to beard trimmer attachments which space beard trimmer blades a desired distance from the skin to produce stubble having the appearance of uniform growth.

BACKGROUND OF THE INVENTION

Electric beard trimmers are available for trimming facial hair in beards and mustaches. Such trimmers include a stationary blade having a substantially straight row of cutting teeth, and a reciprocating blade having a row of cutting teeth which is complementary to the row of teeth on the stationary blade. When facial hair enters a space between adjacent teeth of the stationary blade, a tooth on the reciprocating blade passes across the space, engages the hair, and shears it. Such trimmers are capable of trimming whiskers to within about 0.010 inches from the skin.

Electric beard trimmer comb attachments are available to cut facial hair to selected lengths greater than about 0.090 inches. Such attachments typically include a plurality of fins which extend away from and perpendicular to the row of cutting teeth on the stationary blade. The fins space the cutting teeth a desired distance from the skin. The fins also separate and lift the facial hair strands, or whiskers, and guide them into the cutting teeth of the trimmer.

Some men prefer a one to six day beard growth to a clean shaven face or a longer beard. Sometimes an even longer growth is desired. Since facial hair generally grows about 0.015 inches a day, a six day beard growth produces whiskers which are about 0.090 inches in length. Such shorter whiskers have a smaller length to diameter ratio than longer whiskers, which are more flexible and pliable because of their longer length and larger length to diameter ratio. Whisker growth up to about 0.090 inches in length is sometimes called stubble because the whiskers are relatively rigid and protrude from the face, and have such different characteristics from longer whiskers.

In order to maintain the facial appearance of a one to six day beard growth or more, stubble must be trimmed. Trimming is also needed because some whiskers grow faster than other whiskers, resulting in uneven stubble growth, which is undesirable to some men. However, trimming stubble in an even manner to maintain the appearance of uniform growth is difficult. The use of an electric beard trimmer which is adapted for cutting relatively close to the skin without an attachment usually results in uneven trimming. Known electric beard trimmer atachments which have fins for guiding longer facial hair cannot be adjusted to cut whiskers to a length of less than about 0.090 inches. Thus, there is a need for electric beard trimmer attachments which space the trimmer blades a selected distance from the skin so that trimming produces stubble having the appearance of uniform growth.

Accordingly, one object of this invention is to provide new and improved electric beard trimmers having attachments for trimming stubble and other whiskers.

Another object of this invention is to provide new and improved electric beard trimmer attachments.

Still another object of this invention is to provide new and improved electric beard trimmer attachments which space the cutting teeth of the beard trimmer from the face during trimming to produce stubble having the appearance of uniform growth.

Yet another object of this invention is to provide new and improved electric beard trimmer attachments which trim stubble to a selected length when the cutting teeth of the trimmer are held at various angles to the face.

SUMMARY OF THE INVENTION

In keeping with one aspect of this invention, an attachment is provided for electric beard trimmers which spaces the blades of the electric beard trimmer a desired distance from the skin to produce stubble having the appearance of uniform growth. The trimmer has a stationary blade and a reciprocating blade. The two blades each have a row of cutting teeth for trimming whiskers which enter spaces between teeth on the stationary blade. The stationary blade also has a channel which extends across the stationary blade behind and parallel to the cutting teeth to form an indentation on two edges of the stationary blade. Alternately, there may be some other kind of indentations on the blade instead of or in addition to the channel. The attachment includes a center section which covers the cutting teeth of the trimmer blades, and two side sections which fit around the edges of the stationary blade. Attached to each side section is a protrusion which fits into the channel or other indentations on the edges of the stationary blade to secure the attachment to the electric beard trimmer. The attachment could be secured to the handle of the trimmer, if desired, and by any suitable combination of indentations and protrusions in the trimmer and attachment.

The center section has a plurality of openings, each of which exposes one or more spaces between teeth on the stationary blade when the attachment is installed. The center section spaces the cutting teeth a selected distance from the skin, and the openings allow whiskers to enter exposed spaces between stationary blade teeth so that the whiskers may be trimmed.

The attachment is secured to the electric beard trimmer by placing the center section over the cutting teeth so that the inner surface of the center section is in contact with or close to the teeth. The side sections are made of plastic or the like which is pliable enough so that the protrusions attached to the side sections can be easily pushed over the edges of the stationary blade and into the blade channel or other indentations. The side sections are resilient enough so that the protrusions stay in the channel or indentations during use. The attachment may be easily released by pulling one or both of the protrusions out of their respective indentations. Cut outs may be provided adjacent the side sections, if desired, so that the side sections may be more easily moved.

In use, the attachment maintains a predetermined distance between the trimmer blades and the skin, but does not prevent the exposed spaces between the teeth of the stationary blade from trimming stubble which enters the exposed spaces through the openings in the center section of the attachment. The attachment covers the teeth of the blades so that the stubble may be cut to a selected length when the trimmer blades are held at any of several angles to the face.

BRIEF DESCRIPTION OF THE DRAWINGS

The above mentioned and other features of the invention and the manner of obtaining them will be more apparent, and the invention will be best understood by reference to the following description of the invention taken in conjunction with the accompanying drawings, in which.

DETAILED DESCRIPTION

Figure 1:
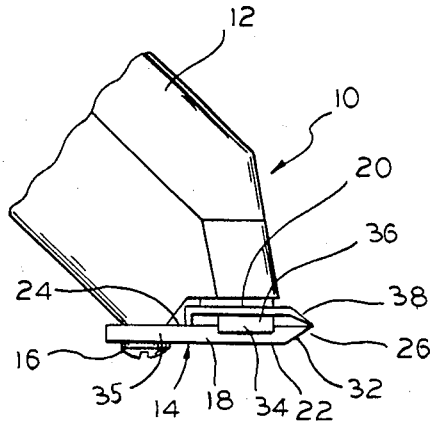
FIG. 1 is a side elevation view of an electric beard trimmer made for use with this invention.
Figure 2:
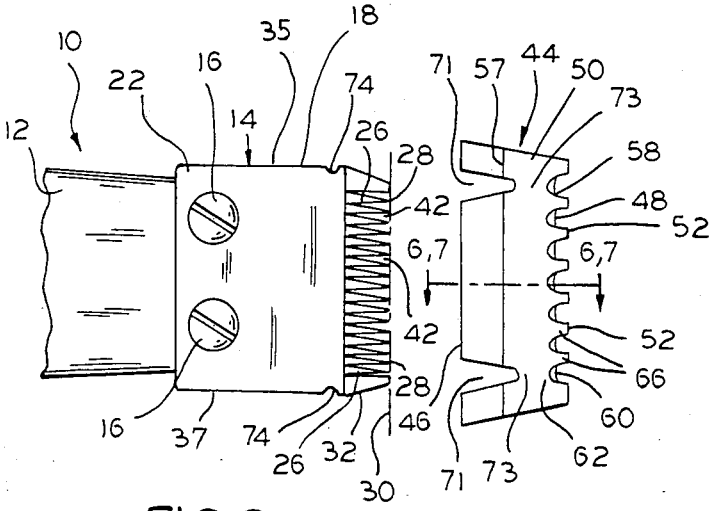
FIG. 2 is a bottom plan view of the trimmer of FIG. 1, and an attachment made in accordance with this invention, shown detached from the trimmer.

Referring to FIGS. 1 and 2, an electric beard trimmer 10 includes a handle 12 and a cutting head 14 secured to the handle 12 by one or more screws 16. The cutting head 14 includes a stationary blade 18 which is secured directly to the handle 12, and a reciprocating blade 20 which is movably secured between the stationary blade 18 and the handle 12, and is operatively connected to a power means (not shown) which causes the blade 20 to reciprocate with respect to the stationary blade 18 during operation.

The stationary blade 18 includes a generally flat outside surface 22 and a flat inside surface 24. The stationary blade 18 includes a substantially straight row of stationary teeth 26 having tips 28 which form a substantially straight blade edge 30. The stationary blade teeth 26 are about 0.010 inches thick at the blade edge 30. The teeth 26 have an outer surface 32 (FIG. 1) which extends from the blade edge 30 to the outside surface 22 at a selected angle.

The surface 24 has a channel 34 which extends from one edge 35 to another edge 37 of the blade 18. The channel 34 extends across the stationary blade 18 behind and in line with the teeth 26. A blade guide 36 is secured to the reciprocating blade 20 and movably fits in the channel 34 to maintain proper alignment of the blade 20 with respect to the blade 18.

Figure 4:
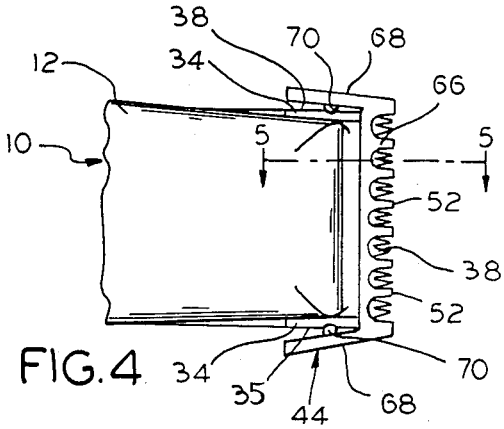
FIG. 4 is a top plan view of the trimmer and attachment of FIG. 3, also showing the attachment secured to the trimmer.
Figure 5:
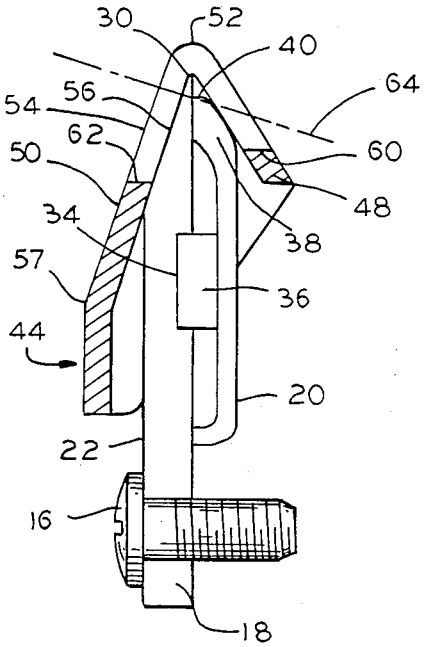
FIG. 5 is a partial sectional view of a portion of the apparatus of FIG. 4, taken along lines 5—5 in FIG. 4.

The reciprocating blade 20 has a row of reciprocating teeth 38 having tips 40, shown partially in FIGS. 1, 4 and 5. The row of teeth 38 generally complements the row of stationary teeth 26. The distance between the blade edge 30 and the tips 40 of the reciprocating teeth 38 is referred to as the set-back of the reciprocating teeth 38. Without an attachment, the configuration of the stationary teeth 26 and the reciprocating teeth 38, as shown and described, will cut whiskers relatively close to the skin.

The stationary teeth 26 form a plurality of spaces 42 (FIG. 2) which are crossed by the reciprocating teeth 38 during operation. In this manner, when a hair strand enters a space 42, a reciprocating blade tooth 38 passes across the space 42, engages the hair strand and shears it.

Figure 3:
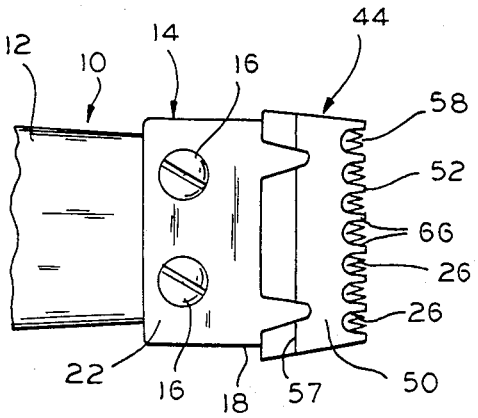
FIG. 3 is a bottom plan view of the trimmer and attachment of FIG. 2, showing the attachment secured to the trimmer.

An attachment 44 (FIG. 2) is provided which covers the teeth on the cutting head 14, as shown in FIGS. 3, 4 and 5. The attachment 44 includes a center section 46 having a top portion 48 (FIG. 5) and a bottom portion 50. The top portion 48 and bottom portion 50 intersect at an apex 52. When the attachment 44 is secured to the trimmer 10 (FIG. 3), the top portion 48 covers the reciprocating teeth 38, the bottom portion 50 covers the stationary blade teeth 26, and the apex 52 covers the tips 28 of the stationary teeth 26. The top portion 48, bottom portion 50 and apex 52 are preferably contiguous, and share an outer surface 54 and an inner surface 56. Both surfaces 54, 56 extend from the top portion 48 through the apex 52 to the bottom portion 50.

The outer surface 32 of the blade 18 is relatively short, as seen in FIGS. 1 and 5. Improved accuracy in trimming may be achieved by extending the bottom portion 50 in a substantially flat plane along the outer surface 32 from the apex 52 to a point 57 which is beyond the surface 32 so that the bottom portion 50 provides a substantially flat surface which is parallel to and larger than the outer surface 32 and may be placed against the face during trimming. In this manner, the tips 40 can be more easily maintained a desired distance from the skin.

A plurality of openings 58 are provided in the center section 46. The openings 58 extend from a point 60 (FIG. 5) in the top portion 48 through the apex 52 to a point 62 in the bottom portion 50. The openings 58 preferably extend far enough along the bottom portion 50 from the apex 52 so that the point 60 is beyond a line 64 drawn through the tips 40 of the reciprocating teeth 38 adjacent the inside surface 24 perpendicular to the outer surface 32 of the stationary teeth 26. The openings 58 create a plurality of spaced fingers 66 in the center section 46 when the attachment 44 is viewed as in FIG. 2.

Figure 6:
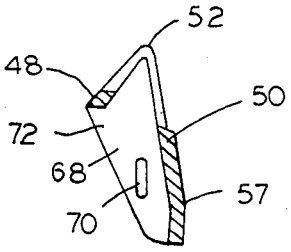
FIG. 6 is a cross-sectional view of the attachment of FIG. 2 taken along lines 6,7—6,7 in FIG. 2.
Figure 7:
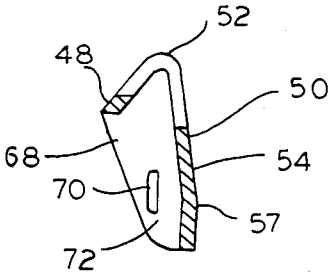
FIG. 7 is a cross-sectional view of an alternate embodiment of the attachment of FIG. 2, also taken along lines 6,7—6,7 in FIG. 2.

The attachment 44 also includes two side sections 68 which are secured to and are preferably contiguous with the sides of the top portion 48, bottom portion 50 and apex 52 of the center section 46. A protrusion 70 extends from an inside surface 72 of each side 68, as shown in FIGS. 4, 6 and 7. The protrusions 70 may be substantially round, as in FIG. 4, or elongated as in FIGS. 6 and 7.

The attachment 44 fits over the stationary teeth 26 and reciprocating teeth 38 of the cutting head 14, leaving selected spaces 42 exposed, as seen in FIGS. 3 and 4. The center section 46 is secured over the teeth 26, 38 and is held in place by the protrusions 70, which fit inside the channel 34. Other indentations, such as indentations 74 in FIG. 2, could be provided in the stationary blade 18 for securement of the protrusions 70, if desired. It is also contemplated that the blade 18 could include protrusions and the attachment 44 could be provided with complementary indentations instead of the protrusions 70, if desired. Various combinations of protrusions and indentations in the attachment 44 and handle 12 are also contemplated. Furthermore, the protrusions may or may not be integral with the structure from which they protrude. Thus, the screws 16 could be used as protrusions.

The attachment 44 may be made of plastic or the like which is pliable enough so that the side sections 68, including the protrusions 70, can be easily placed over the blade edges 35, 37 of the blade 18, and is resilient enough so that the side sections 68 press against the edges 35, 37 of the blade 18 and the protrusions 70 enter into the channel 34. By using such material, the attachment 44 also may be easily removed from the clipper 10 by withdrawing one or both of the protrusions 70 from the channel 34, and removing the attachment 44 from the clipper 10.

The attachment 44 may also be made of less pliable plastic so that the side sections 68 and fingers 66 are fairly sturdy and do not bend or break too easily. Cut outs 71 may be provided when such plastic is used so that the side sections 68 may be more easily bent away from the center section 46 for attaching and removing the attachment 44. The side sections pivot on a hinge section 73 of the center section 68.

When the attachment 44 is secured to the clipper 10, the stationary blade teeth 26, including the tips 28 of the stationary blade teeth 26 which form the blade edge 30, are in contact with or very close to the inside surface 56 of center section 46. Since most whisker trimming takes place at or near the tips 40 of the reciprocating blade 20, the distance between the tips 40 and the outside surface 54 substantially determines the length of the stubble after it is cut. The blade teeth 26 are preferably made so that the distance between the tips 40 and the outside surface 54 is substantially the same whether the distance is measured along the line 64, or adjacent the apex 52. In this manner, the user may place the bottom portion 50 or the apex 58 against the skin, and the length of trimmed stubble will be substantially the same.

In one beard trimmer and attachment made in accordance with the principles of this invention, the stationary teeth 26 of the trimmer 10 had a thickness at the blade edge 30 of about 0.010 inches. The outer surface 32 of the teeth 26 formed an angle of about 18° to the inside surface 24 of the teeth 26. The set-back of the tips 40 of the reciprocating teeth 38 from the blade edge 30 was about 0.010 inches. The apex 52 and the bottom portion 50 of the attachment 44 had a thickness of about 0.020 inches. With that configuration, the distance between the tips 40 at the inner surface 56 and the outer surface 54 of the attachment 44 was substantially the same when the bottom portion 50 or the apex 52 was placed against the skin.

The length of the stubble remaining after the whiskers are trimmed will be determined primarily by the thickness of the center portion 46 adjacent the openings 58. If that part of the attachment 44 is relatively thick, as in FIG. 7, the stubble will be cut relatively long. By making the center portion 46 adjacent the openings 58 thinner, as in FIG. 6, the stubble will be cut shorter. Thicknesses of 0.020 inches and 0.040 inches are considered typical, although other thicknesses between about 0.010 inches and 0.125 inches are contemplated.

It is generally believed that a beard grows about 0.015 inches per day. Thus, a two day growth would be about 0.030 inches long and a somewhat longer growth would be about 0.060 inches long, although many stubble lengths from about 0.010 inches to about 0.090 inches, and even 0.125 inches, are contemplated. The preferred embodiments of this invention would provide a space of either 0.020 or 0.040 inches between the blade edge 30 and the outer surface 54, as measured along the line 64. If the thickness of the teeth 26 along the line 64 is about 0.010 inches, and the set-back of the tips 40 is about 0.010 inches, then the actual length of the stubble using the preferred embodiments of the attachment 44 would be about 0.030 or about 0.050 inches, respectively, regardless of whether the whiskers are trimmed with the bottom portion or the apex 52 placed against the face.

The length of the stubble will be affected somewhat by the direction in which the stubble is cut. That is, stubble which is cut against the natural lay of the whiskers will be somewhat shorter than stubble cut with the natural lay of the whiskers.

The size of the openings 58 are preferably such that a number of blade teeth 26, 38 and spaces 42 are exposed during use. In one embodiment, about twenty-seven stationary teeth 26 were provided in the trimmer 10, and seven openings 58 were provided in the attachment 44. About twenty spaces 42 between teeth 26 were exposed.

The advantages of this invention are now apparent. An attachment is provided for electric beard trimmers which spaces the teeth on the beard trimmer blades a selected distance from the face to produce stubble having the appearance of uniform growth. In addition, the space between the teeth and the face is substantially constant when the cutting teeth of the trimmer are held at various angles to the face.

While the principles of the invention have been described above in connection with specific apparatus and applications, it is to be understood that this description is made only by way of example and not as a limitation on the scope of the invention.

What is claimed is:

1. Apparatus for trimming facial hair comprising:

an electric beard trimmer and an attachment for said electric beard trimmer;

said trimmer having a stationary blade and a reciprocating blade, said stationary blade having a plurality of cutting teeth arranged in a substantially straight row, said stationary blade teeth having tips which form a blade edge, said stationary blade teeth forming spaces into which said facial hair may enter, said reciprocating blade having a plurality of cutting teeth which are complementary to said stationary blade teeth, and are adapted for passing said spaces and engaging and cutting facial hair in said spaces;

said attachment having a center section which covers said stationary blade teeth, said reciprocating blade teeth and said blade edge, a plurality of openings in said center section for exposing a number of said spaces between said stationary blade teeth, and means for selectively securing said attachment to and removing said attachment from said beard trimmer;

said center section having a top portion which covers said reciprocating blade teeth, a bottom portion which covers said stationary blade teeth, and an apex which joins said top and bottom portions, said top portion, said apex and said bottom portion being contiguous;

said center section further including an inner surface which extends from said top portion to said apex and said bottom portion, said inner surface being close to or in contact with said reciprocating blade teeth, said stationary blade teeth and said tips of said stationary blade teeth when said attachment is secured to said beard trimmer, and an outer surface which extends from said top portion to said apex and said bottom portion, the thickness of said center section being between about 0.010 inches and 0.115 inches adjacent said apex;

said openings extending from a part of said top portion through said apex to a part of said bottom portion;

said tips of said reciprocating blade teeth being separated from said blade edge by a set back distance, said stationary blade having a substantially flat inside surface adjacent said reciprocating blade and coextensive with said blade edge, said stationary blade further having a substantially flat outside surface which is spaced from and substantially parallel to said inside surface, said stationary blade teeth having an outer surface which extends from said blade edge to said outside surface at an angle such that said set back distance is substantially equal to the thickness of said stationary blade along a line which intersects any one of said tips of said reciprocating blade teeth and is substantially perpendicular to said outer surface;

said thickness of said center section adjacent said apex combined with said set back distance being substantially equal to the thickness of said bottom portion as measured along said line, combined with the thickness of said stationary blade as measured along said line.

2. Apparatus for trimming facial hair comprising:

an electric beard trimmer and an attachment for said electric beard trimmer, said trimmer having a stationary blade and a reciprocating blade, said stationary blade having a plurality of cutting teeth arranged in a substantially straight row, said stationary blade teeth having tips which form a blade edge, said stationary blade teeth forming spaces into which said facial hair may enter, said reciprocating blade having a plurality of cutting teeth which are complementary to said stationary blade teeth, and are adapted for passing said spaces and engaging and cutting facial hair in said spaces, said tips of said reciprocating blade teeth being separated from said blade edge by a set back distance, said stationary blade having a substantially flat inside surface adjacent said reciprocating blade and coextensive with said blade edge, said stationary blade further having a substantially flat outside surface which is spaced from and substantially parallel to said inside surface, said stationary blade teeth having an outer surface which extends from said blade edge to said outside surface at an angle such that said set back distance is substantially equal to the thickness of said stationary blade along a line which intersects any one of said tips of said reciprocating blade teeth and is substantially perpendicular to said outer surface, said stationary blade having an indentation on each edge of said stationary blade which is adjacent said blade edge, said attachment having a center section which covers said stationary blade teeth, said reciprocating blade teeth and said blade edge, a side section secured to each side of said center section, said center section having a cut-out portion and a hinge section adjacent each side section, said side sections each having a protrusion which fits into a selected said blade indentation, said side sections and said hinge sections being pliable enough so that said protrusions may be placed over said side edges of said stationary blade, and resilient enough so that said side sections press against said stationary blade edges and said protrusions enter said indentations when said center section is properly placed over said stationary blade teeth, said reciprocating blade teeth and said blade edge, said center section having a top portion which covers said reciprocating blade teeth, a bottom portion which covers said stationary blade teeth, and an apex which joins said top and bottom portions, said center section further having a plurality of openings for exposing a number of said spaces between said stationary blade teeth, said openings extending from a part of said top portion through said apex to a part of said bottom portion, said center section having a thickness adjacent said apex which combined with said set back distance, is substantially equal to the thickness of said bottom portion as measured along said line combined with the thickness of said stationary blade as measured along said line.

* * * * *